US006231806B1

(12) United States Patent
Rodrigues et al.

(10) Patent No.: US 6,231,806 B1
(45) Date of Patent: May 15, 2001

(54) SYSTEM FOR THE INJECTION OF GASSES INTO CONTAINERS CONTAINING METALS OR FUSED ALLOYS

(75) Inventors: Angela Rodrigues; Jose Mendes Nunes, both of Belo Horizonte (BR)

(73) Assignee: Magnesita S.A., Montes Claros (BR)

( * ) Notice: Subject to any disclaimer, the term of this patent is extended or adjusted under 35 U.S.C. 154(b) by 0 days.

(21) Appl. No.: 09/348,628

(22) Filed: Jul. 6, 1999

(30) Foreign Application Priority Data

Mar. 1, 1999 (BR) ..... 9900824

(51) Int. Cl.[7] ..... C21C 5/48
(52) U.S. Cl. ..... 266/220; 266/217
(58) Field of Search ..... 266/220, 217

(56) References Cited

U.S. PATENT DOCUMENTS 4,971,295 * 11/1990 Rothfuss et al. ..... 266/220
5,007,366 * 4/1991 Handler ..... 266/220
5,202,079 * 4/1993 Winkelmann et al. ..... 266/220
5,249,778 * 10/1993 Steichert et al. ..... 266/220
5,421,561 * 6/1995 Eisermann et al. ..... 266/220
5,435,528 * 7/1995 Guttery et al. ..... 266/220
5,478,053 * 12/1995 Richter et al. ..... 266/220

* cited by examiner

*Primary Examiner*—Scott Kastler
(74) *Attorney, Agent, or Firm*—Birch, Stewart, Kolasch & Birch, LLP

(57) ABSTRACT

A system for the injection of gasses into containers containing metals or fused alloys, consisting in a device which indicates the end of the useful life of plugs or refractory parts, intended for the injection of gasses into containers containing metals or fused alloys, provided by means of insertion of a metallic tube of carbon steel or stainless steel, into the refractory parts, which upon fusing in contact with the liquid steel, interrupts the flow of gas, indicating the end of the useful life of the system. The system further includes a mechanical device intended to provide safety and support for the plug at the bottom of the ladle, which ensures a perfect seating of the refractory assembly formed by the plug and the sub-plug, in addition to preventing leakage of steel. These two devices may also be used separately: the first, which indicates the end of the useful life of plugs or refractory parts; and the second, the mechanical device for safety and support of the plug at the bottom of the ladle.

4 Claims, 2 Drawing Sheets

SYSTEM FOR THE INJECTION OF GASSES INTO CONTAINERS CONTAINING METALS OR FUSED ALLOYS

STATE OF THE ART

In steelmaking processes, the steel ladle which in the past was used solely for purposes of transportation became, with secondary metallurgy, a steel refining equipment. In this connection, there were noted among other factors an extended time of permanence of the metal within the container, a higher working temperature, and the need that a greater amount of stirring be provided.

The stirring of the metal or alloy is usually achieved with the use of plugs or metallic lances coated with a refractory material. The choice of the lances is due to the possibility of addition of powdered materials, and to the operational safety thereof. The plugs, on the other hand, besides involving a lower cost, are more effective in spite of being limited to the injection of gasses.

The plug is a refractory part through which the gasses are injected, those more commonly used being argon and nitrogen in the case of steel. These gasses promote the bubbling which stirs the metal, or fused alloys. The primary objectives of this bubbling are chemical and thermal homogenization of the steel, as well as the cleaning thereof, since it promotes the withdrawal of inclusions. The plug is usually installed at the bottom of the container. Until the present day, the containers have a maximum number of 3 plugs.

The positioning of the plug at the bottom of the container is calculated in order to achieve the most effective stirring. However, there exist hazardous situations, since there is a discontinuity of the metallic casing of the container, and in consequence the possibility exists of the plug being excessively eroded to the point of allowing leakage of the metal. The results of this leakage may include from the partial or total loss of the metal, to the loss of human lives, including the destruction of equipments.

Having in view the importance of the safety consideration when employing plugs, it is believed that the safety systems having been developed to date are still unreliable. Some of these devices are described below:

Devices intended for evaluating the wear of the plug:

The existing devices are based upon visual examination. They may be constituted by a refractory material with different thermal conductivity from that of the plug itself, and will exhibit a different color upon being reached, during the course of wear of the plug. There also exist references which have cross sections of different geometries, with a square section body, within a circular section plug.

These references are, however, evaluated by means of analysis of the working face of the plug, i.e., by the inner side of the container wherein the metal is processed, and therefore it is required that this container be empty, and this takes place upon the pouring or ingot forming having been performed. This makes it impossible to evaluate the plug during the processing of the metal, restricting the possibilities of evaluation, and consequently decreasing the safety of the plug.

The plugs may be graded in accordance with the refractory material used, and they may be alumina based or magnesia based for instance. They may also be graded as being porous or having directional passage, which are distinguishable primarily by the fashion in which the gas passes therethrough, which in turn is evaluated by flow rate. The flow rate measures the volume of gas which passes by the part, per unit of time, and varies according to the pressure of this gas. In the porous plug the flow rate is associated with its permeability. For directed porosity plugs, on the other hand, the flow rate will depend on the dimension and number of "slits" or openings present in the refractory material.

Mechanical devices intended for safety and support of the plug at the bottom of the ladle:

The mechanical support devices normally used are of the bayonet or spline types which do not ensure the degree of safety required for this application. The bayonet or spline devices are much dependent on the manner in which the operator makes the installation, and may become unstable systems and be subject to cause serious accidents when in operation.

New Injection System for Gasses

The new system for the injection of gasses comprises the new device for indicating the end of the useful life of plugs and a new mechanical device to provide safety and support for the plug at the bottom of the ladle. These two devices when installed together provide better safety to the operation, although they may be installed and used separately.

BRIEF DESCRIPTION OF THE DRAWINGS

This system will be better understood by means of the detailed description as follows, in consonance with the attached FIGS. 1 and 2.

NEW DEVICE FOR INDICATING THE END OF THE USEFUL LIFE OF THE PLUG

Figure 1:
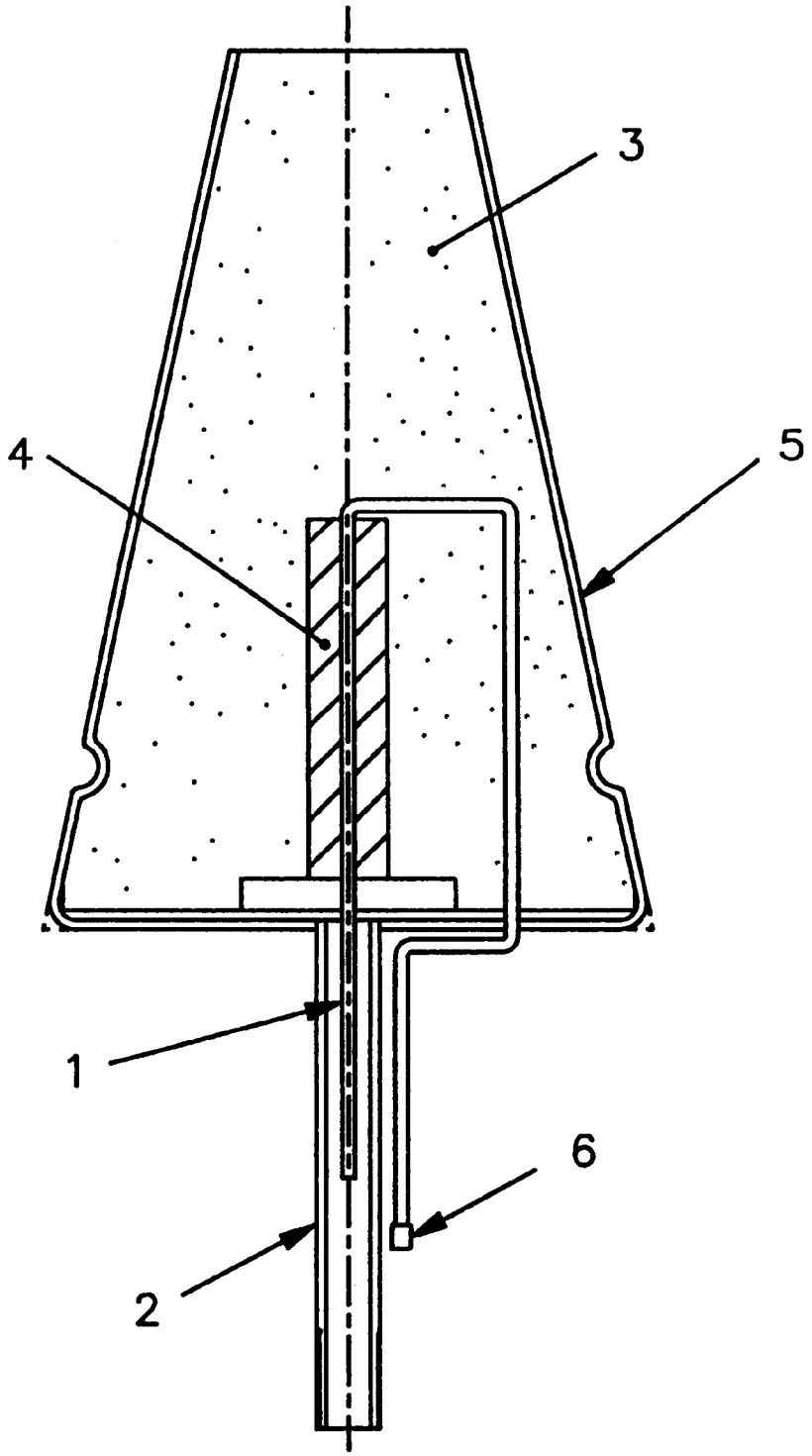
Figure 2:
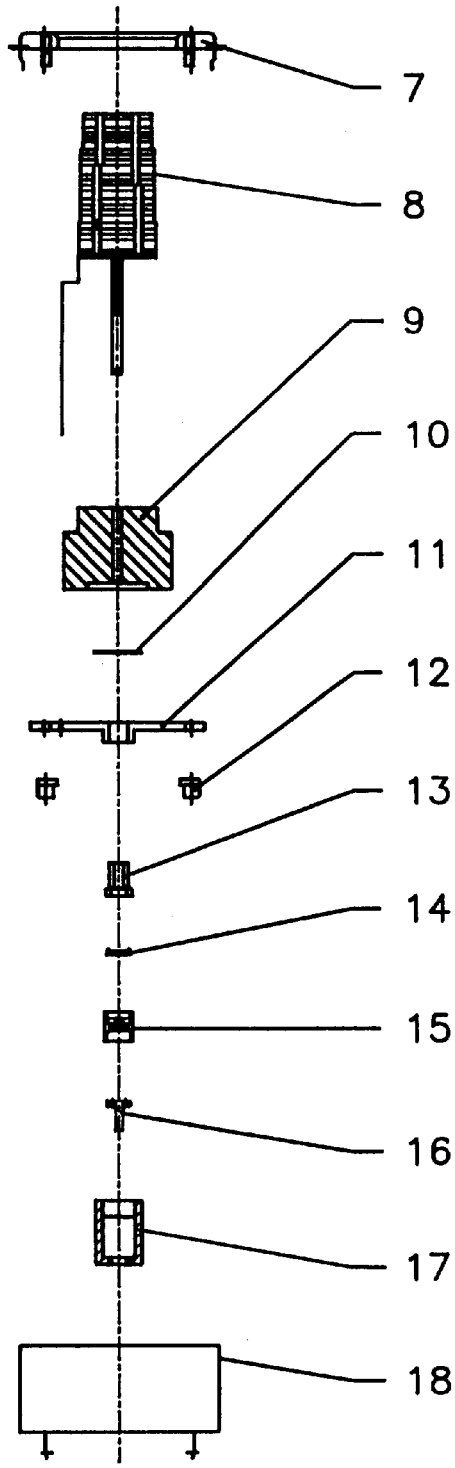

The new device consists of a carbon steel or stainless steel tube (1), inserted within a plug as shown in FIGS. 1 and 2. The tube (1) is inserted through the stem (2) of the plug, passes through the plug's refractory material (3), or through the reference material (4). Inside the plug, this tube has a length which is coincident with the residual length of the plug after use. This length may be varied according to the user's requirements, but is generally between 80 and 110 mm. The tube is arcuate within the plug and follows the same downwards, exiting at the base, facing the metallic coating (5) of the plug, until it meets the stem. The outer length of the tube may be shorter than or equal to the length of the stem. The end of the tube is sealed, to prevent loss of gas, with a ball valve (6), or another device, with the purpose of allowing testing of gas output, that is, allowing the passage of gas upon being actuated. During the tests carried out, it was observed that the most adequate dimensions for the tube were between 2 and 8 mm for the internal diameter, the tube wall having a thickness appropriate to withstand the gas pressure.

The purpose of the device is to indicate the residual length of the plug, to determine whether the part should be withdrawn from operation. The indication is made from outside the container, which consequently does not need to be empty. The indication is perceived by touch, minimizing the incidence of errors of evaluation due to human miscalculation, which take place more often in cases where mere visual indication is used.

New Mechanical Device for Safety and Support of the Plug at the Bottom of the Ladle It is believed that the safety systems developed to date are still precarious, and for this reason there has been studied a new gas injection system, which is described in the present document.

The most complete safety systems should consist in a device intended for the evaluation of the plug's wear and a mechanical device ensuring safety and support of the plug at the bottom of the container or ladle.

The new mechanical device may be better understood by means of the following detailed description, in consonance with the attached FIG. 2.

FIG. 2 represents a longitudinal view, in cross section, of the new mechanical device.

The new mechanical device consists in a mounting plate (7) which is a metallic piece with a center hole having a diameter such as to allow passage to the plug and the sub-plug. It is responsible for the attachment to the ladle of the remaining components of the device. This plate is welded to the bottom of the ladle.

The refractory plug (8), already detailed in FIG. 1, through which the gas is injected into the steel ladle, is placed at the bottom of this ladle. Below the plug there is placed the sub-plug (9). The sub-plug is a refractory piece having an irregular outer surface, not straight shaped, but rather in the shape of a labyrinth or maze, as shown in the schematic drawing in FIG. 2. This irregular surface is intended primarily to increase the safety of the device, avoiding that an eventual infiltration of steel around the plug may proceed until there occurs a leakage of the metal bringing about operational or personal damage.

The retaining plate (11) is a metallic piece which is fixedly attached to the mounting plate (7) by means of cap nuts (12). The retaining plate (11) ensures the fixed attachment of the plug (8) and the sub-plug (9) in a stable and secure fashion at the bottom of the ladle.

The adjusting ring (10) and the adjusting nut (13) are metallic parts which comprise the fine adjustment system, which provide the tightening of the plug/sub-plug assembly, and consequently allowing a better seating, minimizing deleterious effects of possible dimensional variations of this refractory assembly. The adjusting ring (10) is a free part, which is pushed towards the sub-plug, by means of the turning of the adjusting nut (13), which in turn is threadedly attached to the retaining plate (11).

The safety block (15) is threadedly attached to the upper coupling (14), which in turn is attached, also by threading, to the stem of the plug (8). The lower coupling (16) is also threadedly attached on the lower face of the safety block (15). The free end of the lower coupling (16) is thus available for connection to the factory's gas hose or piping. The safety block (15) is a copper body with internal openings which allow the passage of gas. Its function is to block the infiltration of steel that may pass by the stem of the plug. This copper body, due to having a low melting point and a high thermal conductivity, once reached by the liquid metal, melts quickly and solidifies immediately thereafter, blocking the passage of metal, avoiding accidents. Obviously, at these times, the passage of gas will also be interrupted, and the plug, together with the damaged parts of the device, will have to be replaced.

The container block (17) has the primary function of securing the safety block (15) in place, in addition to protecting the same from mechanical impact. The container block (17) is therefore threadedly attached to the retaining plate (11). This block further includes an opening in the lower face, through which passes the free end of the connection (16). As already mentioned, this said end is connected to the factory's gas hose or piping.

The protective cover (18), in turn, protects the whole device against splashing of steel or slag from the process, and also from mechanical impact. The protective cover (18) is coupled to the mounting plate (7), by a pin welded to this plate (7) and a slit having a special shape at the cover (18), in order to achieve a perfect coupling during operation.

Operation

New Device Intended to Indicate the End of the Useful Life of the Plug

The device which serves to indicate the end of the useful life of the plug, that is, the plug and metallic tube assembly, is installed in the container, for instance in the steel ladle. This ladle is heated and receives the metal or metallic alloy. During the processing of this metal there take place injection of gasses which promote the bubbling and stirring already mentioned. The parameters related to the injection of gasses, as the gas used, the time and the blowing pressure, depend on the quality of the metal or the alloy that is being processed.

During the injection of the gas, the passage of gas at the exposed end of the metallic tube will indicate that the same is intact, and that the plug may remain in operation. Otherwise, that is, if the passage of gas is interrupted, the metal being processed may have reached and damaged the tube, indicating that the plug should be withdrawn from the container. The test to verify the passage of gas may be done while cleaning the tube, when the container is empty; or yet, even during operation, which renders it different from the remaining systems for indicating the end of the useful life of the plug.

The device disclosed herein indicates therefore the residual or reference length of end of useful life of the plug, in any one of the process steps, provided that there exists the possibility of injecting gas through the stem of the plug. Therefore, one may anticipate the behavior of the plug or the intense abnormal wear of the same, consequently minimizing the risk of accidents.

New Mechanical Device for Safety and Support of the Plug at the Bottom of the Ladle The new mechanical device for safety and support of the plug at the bottom of the ladle, in turn, has a mounting plate having a central orifice with a diameter such as to allow the passage of the plug and the sub-plug. This plate is welded to the bottom of the ladle.

The plug and the sub-plug are then installed in such fashion that the lower surface of the sub-plug is flush with the mounting plate. The plug is a refractory part through which the gasses are injected, as already mentioned, and the sub-plug is a refractory part with an irregular outer surface, not with a straight shape, but in the shape of a labyrinth or maze, as shown schematically in FIG. 2. This irregular surface is primarily intended to increase the safety of the device, rendering difficult that an eventual infiltration of steel around the plug may proceed to the point of leakage of the metal and that it might cause operational or personal damage.

The adjusting ring, the retaining plate and the adjusting nut are mounted in advance, forming an assembly of metallic parts responsible for the attachment and the adjustment of the refractory assembly of the plug and the sub-plug. The adjusting ring and nut are the parts that allow a better seating, since they minimize the negative effects of possible dimensional variations of the refractory assembly. This assembly, the adjusting ring, the retaining plate and the adjusting nut, is then attached to the mounting plate by means of cap nuts. This assembly further includes a small central orifice, with a diameter allowing just the passage of the plug stem.

The assembly comprised by the upper coupling, the safety block and the lower coupling is also pre-assembled and shall be attached, by threading, to the plug stem. The safety block stops infiltration of steel through the stem of the plug. This also serves to avoid operational or personal damage.

The container block is then threadedly attached to the retaining plate, attaching and protecting the safety block, against mechanical impact and mainly retaining the safety body, in case of infiltration of steel by the stem.

The protective cover, in turn, is attached to the mounting plate by a pin welded to this plate and a special shaped slit in the cover, in order to maintain a perfect attachment during operation. The protective cover protects the entire device against splashing of steel or slag from the process, and also from mechanical impact.

Upon the end of the useful life of the plug, the same is replaced with a new plug. For this purpose there is first detached the protective cover, followed by the container block, then by the assembly which contains the safety body, and finally, by the assembly comprised by the retaining plate, adjusting ring and nut. The sub-plug is then withdrawn and evaluated, and may be returned to operation if found not to be damaged. The used plug is finally withdrawn and a new one is installed. The parts and assembly of parts which comprise the new safety and support device for the plug at the bottom of the ladle are then mounted once again.

What is claimed is:

1. A device for injecting a gas or gasses into a container containing a liquid molten metal, metals or fused alloys, comprising:

a first member for indicating the end of the useful life of a plug in said container or of a refractory part of said container, wherein the first member contains a carbon steel or stainless steel tube with a diameter of 2 to 8 mm and which, by fusion of the steel tube, when said tube is in contact with the metal, metals or fused alloys, interrupts the flow of gases in said tube, thereby indicating the end of the useful life of said plug or said refractory part of said container; and wherein an end of the carbon steel or stainless steel tube is exposed and sealed with a sealing means that allows for the testing of gas output.

2. A device for injecting a gas or gasses into a container containing a liquid molten metal, metals or fused alloys, comprising:

a first member for indicating the end of the useful life of a plug in said container, wherein the first member contains a carbon steel or stainless steel tube with a diameter of 2 to 8 mm and which, by fusion of the steel tube, when said tube is in contact with the metal, metals or fused alloys, interrupts the flow of gases in said tube, thereby indicating the end of the useful life of said plug of said container; and a second member in association with said first member, wherein the second member is a mechanical member intended to give safety and support to said plug in said container, by ensuring the perfect seating of the first member in the container, the second member comprising:

a mounting member for mounting said first member to said container, a retaining member attached to the mounting member to ensure said first member is attached stably and securely to the container, and a safety blocking member to prevent the infiltration of the liquid molten metal, metals or fused alloys to said first member; and wherein an end of the carbon steel or stainless steel tube is exposed and sealed with a sealing means that allows for the testing of gas output.

3. A device for injecting a gas or gasses into a ladle container containing a liquid molten metal, metals or fused alloys, comprising:

a first member for indicating the end of the useful life of a plug in said container, wherein the first member contains a carbon steel or stainless steel tube with a diameter of 2 to 8 mm and which, by fusion of the steel tube, when said tube is in contact with the metal, metals or fused alloys, interrupts the flow of gases in said tube, thereby indicating the end of the useful life of said plug of said container; and a second member in association with said first member, wherein the second member is a mechanical member intended to give safety and support to said plug in said container, by ensuring the perfect seating of the first member in the container, the second member comprising:

a mounting member for mounting said first member to said container, a retaining member attached to the mounting member to ensure said first device is attached stably and securely to the container, and a safety blocking member to prevent the infiltration of the liquid molten metal, metals or fused alloys to said first member; and wherein an end of the carbon steel or stainless steel tube is exposed and sealed with a sealing means that allows for the testing of gas output.

4. A device as recited in claim 1, 2 or 3, wherein said sealing means is a ball valve.

* * * * *